US005273108A

United States Patent [19]

Piper

[11] Patent Number: 5,273,108

[45] Date of Patent: Dec. 28, 1993

[54] CLOSURE APPARATUS FOR BLOW OUT PREVENTION

[75] Inventor: Britton F. Piper, Edmond, Okla.

[73] Assignee: Piper Oilfield Products, Inc., Oklahoma City, Okla.

[21] Appl. No.: 964,092

[22] Filed: Oct. 21, 1992

[51] Int. Cl.[5] ..... E21B 33/06

[52] U.S. Cl. ..... 166/90; 166/86

[58] Field of Search ..... 166/82, 84, 86, 88, 166/90; 251/1.1, 1.2, 1.3

[56] References Cited

U.S. PATENT DOCUMENTS

| | | | |
|---|---|---|---|
| 2,642,942 | 6/1953 | Reynolds | 166/90 |
| 2,746,709 | 5/1956 | Minor | 251/1 |
| 3,207,221 | 9/1965 | Cochran et al. | 166/86 |
| 4,640,372 | 2/1987 | Davis | 166/90 X |
| 4,646,844 | 3/1987 | Roche et al. | 166/86 X |

*Primary Examiner*—Thuy M. Bui

*Attorney, Agent, or Firm*—Dougherty, Hessin, Beavers & Gilbert

[57] ABSTRACT

Blow-out prevention apparatus consisting of a body housing having upper and lower annular chambers opening on an axial bore that provides communication into the wellbore. First and second toroidal-type packers are then arrayed around each of the upper and lower annular chambers, and an insert packer cylinder including upper and lower sleeve packers is disposed within the axial bore with upper and lower sleeve packers adjacent respective first and second toroidal packers. Upon emergency activation, the first and second toroidal packers are expanded inward to force the upper and lower sleeve packers inward thereby closing off the axial bore. An injector is then actuatable to provide rapid injection of a viscous plugging agent into the central void between the upper and lower sleeve packers.

18 Claims, 5 Drawing Sheets

CLOSURE APPARATUS FOR BLOW OUT PREVENTION

BACKGROUND OF THE INVENTION

1. Field of the Invention.

The invention relates generally to blow-out preventers for use in closing well bore casement and, more particularly, but not by way of limitation, it relates to an improved blow out preventer for use during work over situations wherein submersible pump cables or other members are suspended in the well bore.

2. Description of the Prior Art.

The prior art includes a great number of blow-out preventer devices that are suitable for completely closing the well bore during an emergency situation, such hole closure devices utilize various mechanisms including hybrid form packers, gate valves and other plugging devices in effecting the reliable and tight hole closure. U.S. Pat. No. 2,746,709 in the name of Minor is but one prior teaching wherein a contractible rubber packer is actuated to seal off the annulus between a casing and an axially aligned tubing string. In the absence of tubing, the device is also effective to contract to a completely closed position thereby sealing off the casing extremities therebelow.

SUMMARY OF THE INVENTION

The present invention relates to an improved form of blow out preventer that is particularly suitable for closing off a well bore having cables or rods extending downward therethrough. The device includes a body member for mounting on a wellhead or such with the body member having a central bore through which an insert packer member is inserted. The insert packer member is of cylindrical form and includes opposite end mandrels each connected to first and second packer sleeves which, in turn, are joined by a perforated central spacer ring. The insert packer is retained axially within the body housing which includes peripheral, hydraulically actuated packer assemblies coaxial to each of the sleeve packer segments on the insert packer such that the peripheral packers can be actuated to contract inward and force the sleeve packers in tightly around the axially aligned one or more cables or rods, whereupon injector assemblies positioned on the outer edge of the body housing can be actuated to inject a very viscous plugging agent into the central void between sleeve packers thereby to finally seal off the well casing.

Therefore, it is an object of the present invention to provide a blow out prevention device that is effective to seal off the bore despite the presence of a non-symmetrical body extending axially down the bore.

It is also an object of the present invention to provide a borehole closing apparatus for sealing around irregular impediments which has a relatively long life of usage through repetitive actuations.

It is yet further an object of the present invention to provide a closure device that employs a two-stage closing operation of packers plus plugging agent injection to insure maximum sealing capability.

Finally, it is an object of the present invention to provide such hole closure apparatus for blow out prevention that is capable of rapid, reliable actuation as well as repeated usage.

Other objects and advantages of the invention will be evident from the following detailed description when read in conjunction with the accompanying drawings which illustrate the invention.

DETAILED DESCRIPTION OF THE INVENTION

Figure 1:
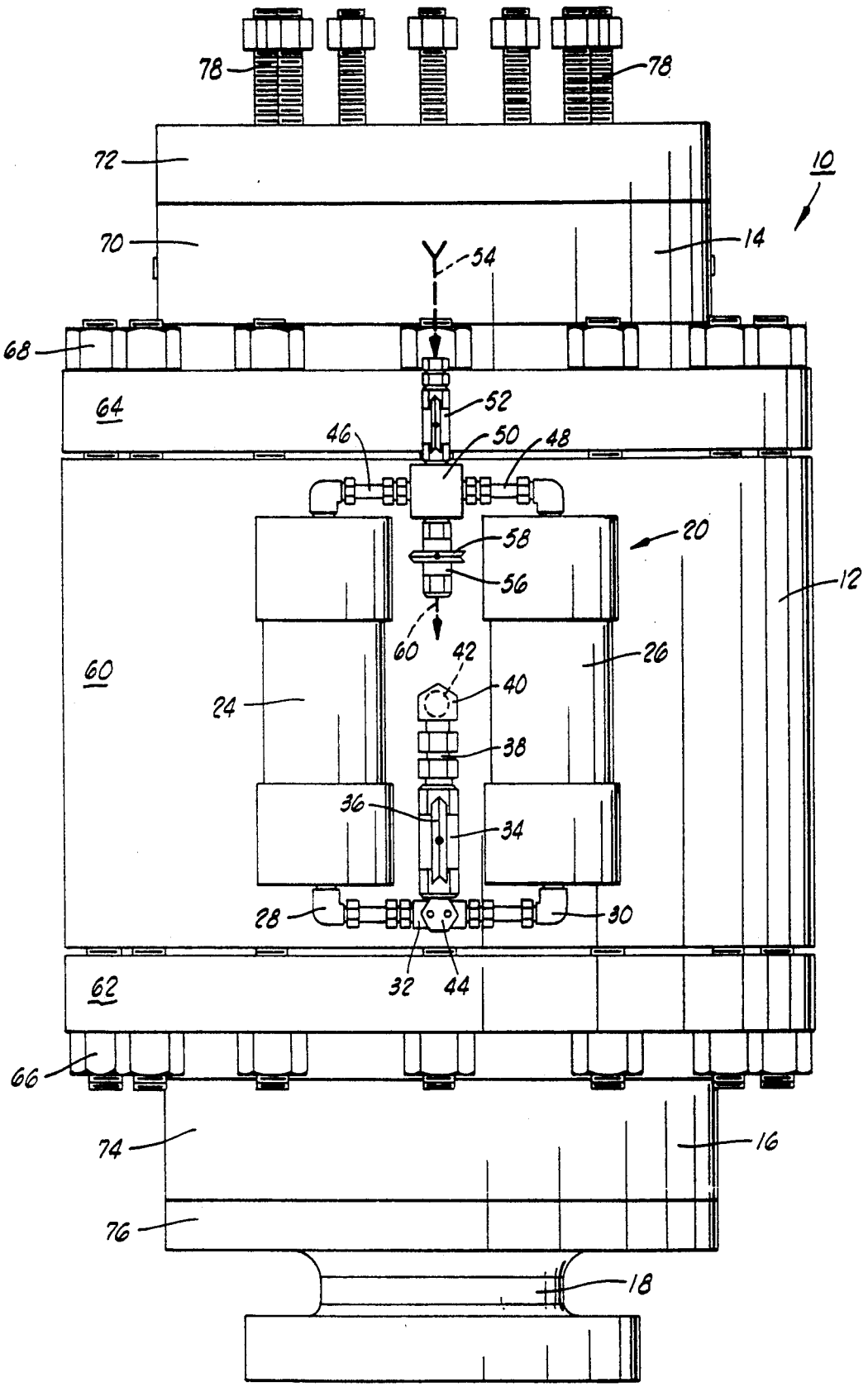
FIG. 1 is a side view in elevation of the blow-out prevention device as constructed in accordance with the present invention.

Referring to FIG. 1, a blow-out preventer 10 consists of a central body member 12 having an upper bonnet assembly 14 and a lower bonnet assembly 16 secured above and below, respectively. A lower flange assembly 18 is provided to interconnect between the lower bonnet assembly 16 and the associated wellhead (not shown).

A pair of injector assemblies 20 and 22 (see also FIG. 2) are located on each side of the body member 12. Each of the body members 20 and 22 are actuated to inject a plugging agent into the central bore of blow out preventer 10, as will be further described below. The injection assembly 20 consists of parallel-connected hydraulic injectors 24 and 26 having respective output conduits 28 and 30 connected through a T-connection 32 to a ball valve 34. The ball valve 34, shown in the open position by actuator 36, is connected via conduit 38 and right-angle fitting 40 which is threadedly secured in a radial bore 42 leading into the body member 12, as will be further described. A spanner cap nut 44 is threadedly secured into T-connector 32, and this cap nut 44 functions to provide access for periodic recharge of plugging agent.

The upper ends of injectors 24 and 26 receive controlled pressure hydraulic oil input via conduits 46 and 48, respectively, each of which is connected to a distribution block 50. Also connected to distribution block 50 are a ball valve 52, with actuator shown open, which receives input of hydraulic oil under pressure via dash-line 54, and the opposite side of distribution block 50 is connected with a ball valve 56, shown in the closed position. During recharge of plugging agent, the ball valve 56 is actuated to the open position to allow recovery flow of hydraulic fluid via dash-line 6 to the hydraulic oil system reservoir. The conduit structure of opposite side injector assembly 22 (see FIG. 2) is exactly the same using counterpart injectors 24 and 26 and identical plumbing interconnection.

Figure 2:
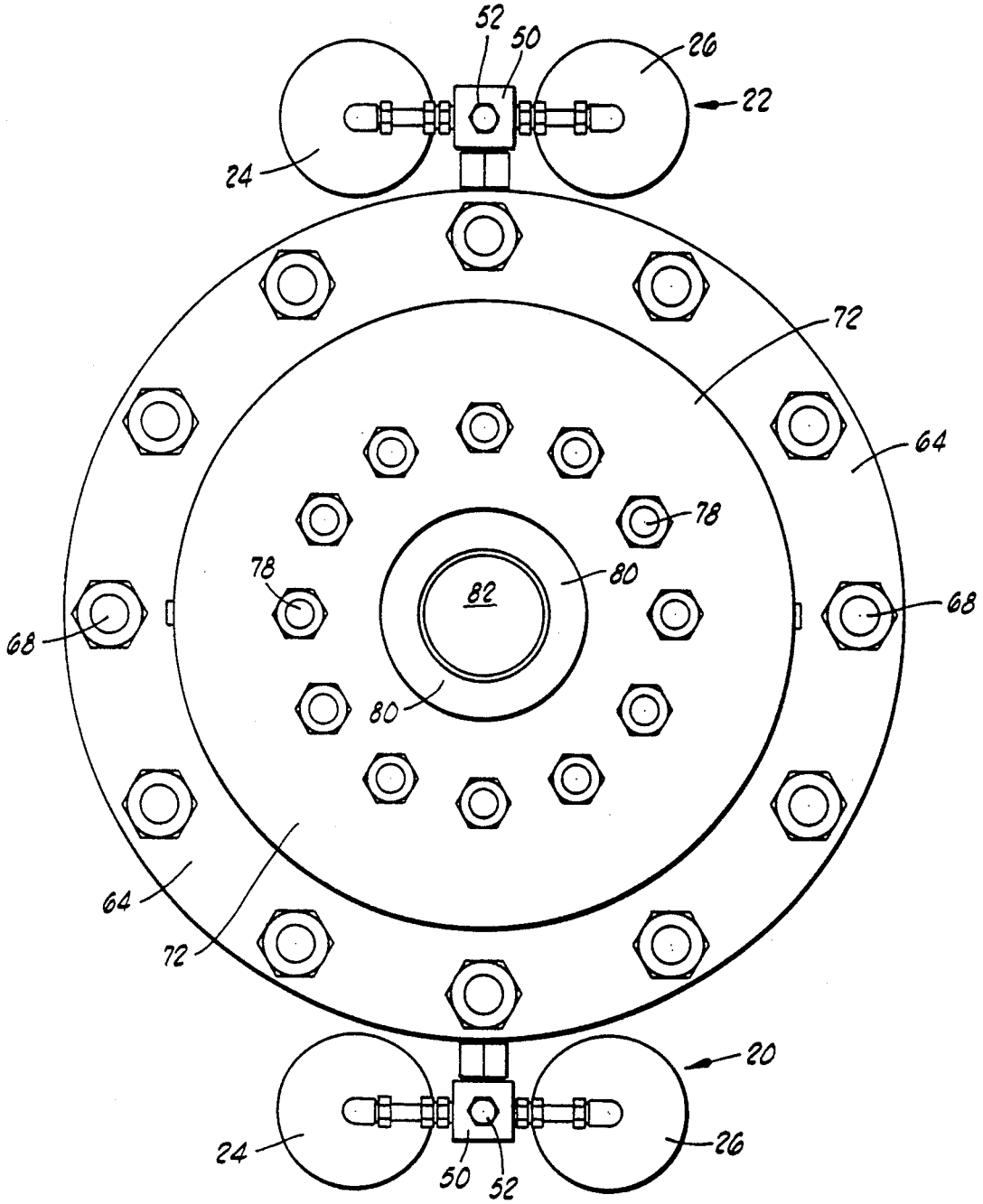
FIG. 2 is a top plan view of the assembly of FIG. 1.

The body member 12 consists of a central body housing 60 having a lower flange plate 62 and an upper flange plate 64 securely bolted thereon in sealing engagement by means of the pluralities of circumferentially arrayed bolts 66 and 68, respectively. A middle bonnet plate 70 and upper bonnet plate 72 are then sealingly secured above flange plate 64 by means of peripheral bolting, to be further described. Similarly, the lower flange 62 is bolted to a middle plate 74 which, in turn, is bolted to the upper flange 76 of lower flange assembly 18. The upper circular array of bolts 78 are provided for interconnection to whatever the next equipment in the mounting configuration. FIG. 2 also shows the upper end of an insert packer 80 and axial bore 82.

Figure 3:
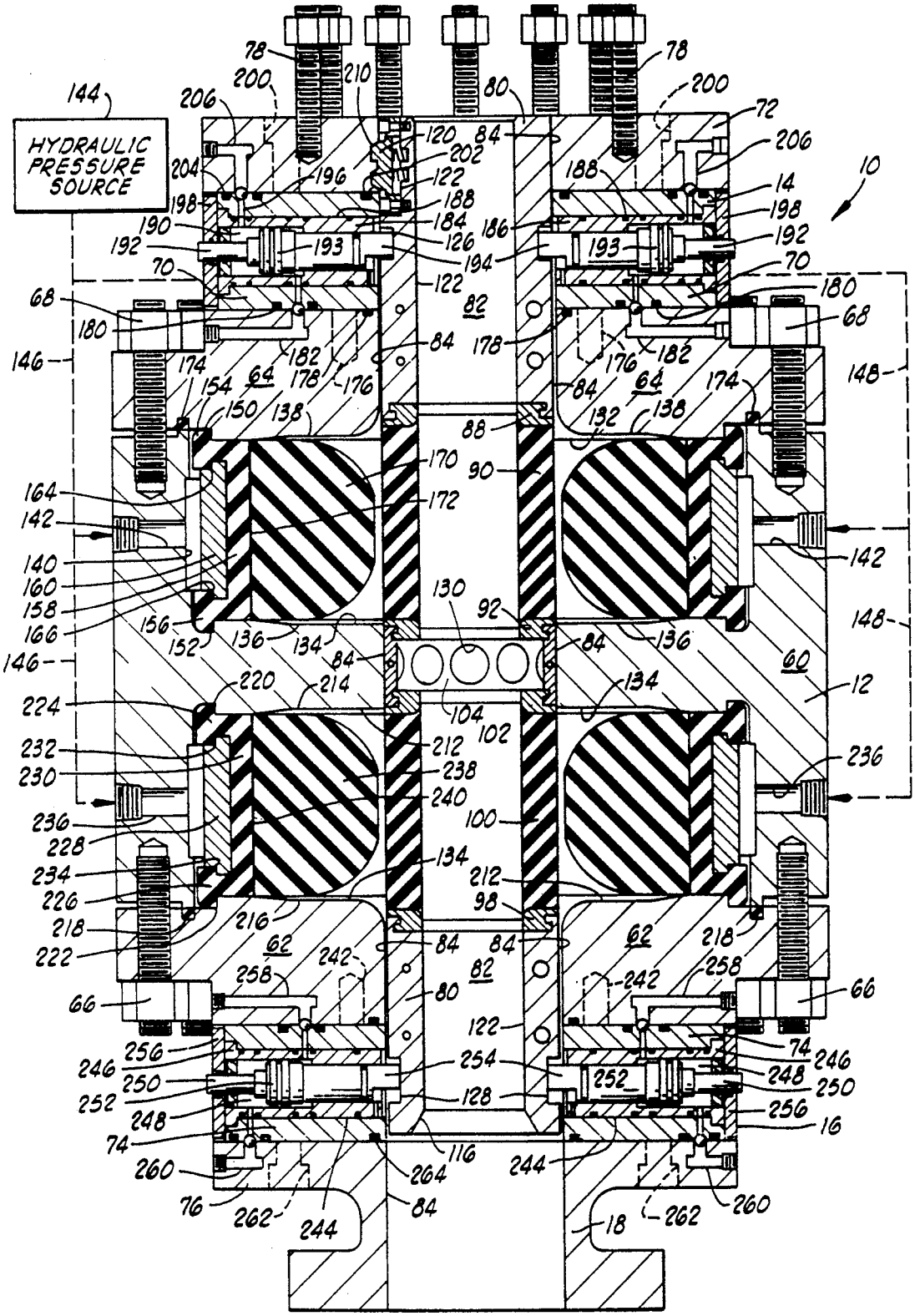
FIG. 3 is a view in vertical cross section of the blow-out preventer when in the quiescent stage.

Referring now to FIG. 3, the assembly of body components defines a central bore 84 which receives the insert packer 80 therein. The insert packer 80 is a cylindrical assembly and is shown to better advantage in FIG. 4. Thus, an upper mandrel 86 is interconnected with a tongue-groove connecting ring 88, which is bonded to rubber packer 90. The other end of packer 90 is also bonded to a tongue-groove connecting ring 92. A lower mandrel 94 is constructed generally similar to upper mandrel 86 and includes tongue-groove structure for connection with a connecting ring 98, the bonded end ring of a lower packer 100 which also has bonded thereon a tongue-groove connecting ring 102. A spacer ring 104 having groove formations 106 and 108 on opposite ends then joins the upper and lower halves of the insert packer 80 by tongue-groove engagement of connecting rings 92 and 102 in the respective groove formations 106 and 108.

Figure 4:
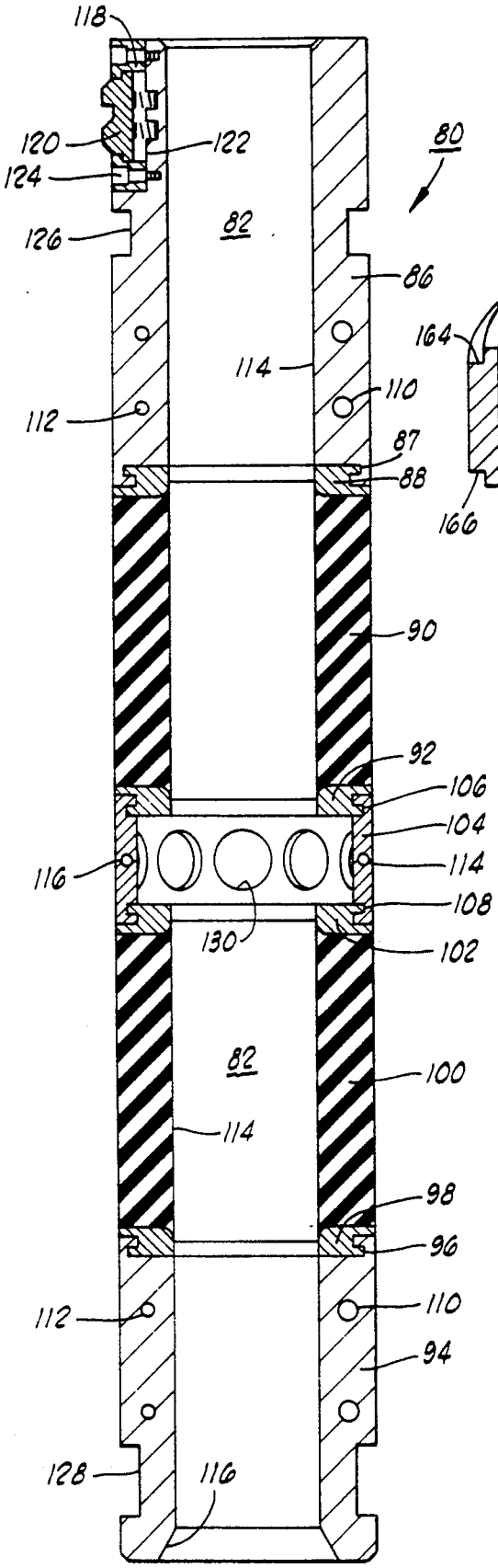
FIG. 4 is a view in vertical section of the insert packer assembly of the blow-out preventer.

The insert packer 80 is made up of two half sections as shown in FIG. 4, which are then assembled face-to-face and held rigidly in tubular or cylindrical form by screw fastened through holes 110 into threads 112. Similar threaded fastener engagement is made through opposed spacer rings 104 by means of holes 114 and 116. Assembly of all components of the insert packer 80 results in defining a smooth interior wall 114 which terminates in a bottom end bevel 116 to aid in entry of a submersible pump when drawn upward therethrough.

A locking insert 118 having a spring-loaded dog latch 120 is secured into a recess 122 by means of screws 124 at the upper end of upper mandrel 86. The dog latch 120 is effective in initial set up of the equipment for location of the insert packer relative to the body housing 12, as will be further described. A circular channel 126 is formed around the outer surface of upper mandrel 86 for receiving insert of locking pistons, as will be further described. Similarly, a circular groove 128 is formed around the outer surface of lower mandrel 94 for reception of similar locking pistons. The spacer ring 104 includes a plurality of radially aligned holes 130 that allow free inward flow of viscous plugging agent when the blow out preventer 10 is operated to its safeguard attitude.

Referring again to FIG. 3, the body housing 60 is formed with upper and lower annular channels 132 and 134 which open inwardly to the central bore 84. The upper channel 132 is formed by a side wall 136 of body housing 60 coupled with an upper side wall 138 formed by the overlaying portion of the lower bonnet flange 64 as tightly positioned by the circumferal array of bolts 68. The annular channel 132 is completed by the generally cylindrical outer wall 140 which is in communication through a plurality of radial ports 142 with a hydraulic pressure source 144 and oil distribution line shown by dash-lines 146 and 148.

Annular notches 150 and 152 are formed around the outermost upper and lower extremities of annular chamber 132, to provide interlocking seating for respective rubber tabs 154 and 156 which are formed on opposite sides of an outer packer 158. Outer packer 158 is formed as a unitary piece to accommodate the inner corners of tabs 154 and 156 by means of a split keeper ring 160 (see also FIG. 5). The split keeper ring 160 is formed as a semi-cylindrical band having a plurality of radial holes 162 formed therethrough. The outer corners of band 160 each include a right angle groove 164 and 166 for the purpose of interlocking under respective outer packer tabs 154 and 156. Thus, the keeper ring 160 maintains the outer packer tabs 154 and 156 in position within respective housing notches 150 and 152 while hydraulic oil is free to travel into bore 142 and through keeper ring holes 162 to cause inward enlargement of outer packer 158.

A doughnut or toroidally shaped inner packer 170 is also disposed in annular gap 132 with flat outer face 172 flush against the outer packer 158. Each of outer packer 158 and inner packer 170 are formed from a relatively low durometer rubber such that they are capable of extensive expansion creep under radial inward force. The inner packer 170 is disposed adjacent the rubber packer 90 of insert packer 80 and functions to distend the packer inward when actuated, as will be further described below.

The lower bonnet flange 64 of upper bonnet assembly 14 is secured over central body housing 12 by means of the circumfery of bolts 68 disposed around the outer periphery. Integrity of the joinder is maintained by a circular seal 174. The middle bonnet plate 170 is then secured thereover by means of a plurality of circumferentially arranged screws 176 and a circular seal 178. Ring seals 180 provide seal integrity around a plurality of hydraulic ports 182 which interconnect with plural locking cylinders 184 and 186. Actually, FIG. 3 shows the use of diametrically opposed locking cylinders 184 and 186 for the sake of clarity; however, it should be understood that a desired array would utilize three equi-spaced locking cylinders arrayed at 120° spacing, both upper and lower cylinders.

Each of the locking cylinders is similarly constructed as each is disposed in a radial bore 188 formed at 120° intervals around middle bonnet plate 70. The respective locking cylinders 184, 186 plus are then set into the radial bores 188 with proper circular seals whereby a cylinder reaction space 190 is defined. A piston member 192 having piston rings 192 and a locking plunger 194 is then slidably disposed in cylinder 184 such that hydraulic pressure control via ports 182 and 196 can effect reciprocal actuation. The piston 192 is shown in the actuated closed position with plunger lock 194 engaged within the annular groove 126. A suitable circular cylinder head 198 is secured around the middle bonnet plate 70 and secured by threaded fasteners (not shown).

The upper bonnet plate 72 is then secured on top of middle bonnet plate 70 by means of flush-mounted bolts 200 in circular array. The upper bonnet plate 72 includes a suitable circular seal 202 as well as ring seals 204 which seal the hydraulic port 206 interconnecting with port 196 of the middle bonnet plate 70. The upper bonnet plate 72 also has formed in communication with the central bore 84 a double notch 210 for coaction with the spring-loaded locking insert 120 as contained on the outer surface of upper mandrel 80.

The lower half of body member 12 and lower bonnet assembly 16 are identically constructed to their counterparts in the upper structure, i.e., the top half of body member 12 and the upper bonnet assembly 14. Thus, the body housing 60 includes a second annular chamber 212 disposed in parallel, spaced relationship from upper annular chamber 132 and opening onto the central bore 84. Thus, annular chamber 212 is formed by a lower wall 214 of body housing 60 as it is joined to upper wall 216 of lower flange plate 62, with the chamber integrity maintained by a circular seal 218. The annular chamber 212 is formed with inner corner notches 220 and 222 which serve to capture and retain packer tabs 224 and 226 with the aid of the split keeper ring 228 which is securely retained within outer packer 230. The split keeper ring 228 (160) is formed with corner notches 232 and 234 which aid in gripping the packer tabs 224 and 226, respectively.

Figure 5:
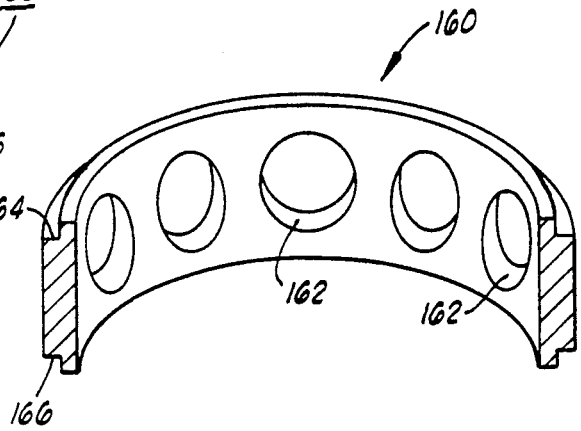
FIG. 5 is a perspective view of a split keeper ring as employed in the present invention.

The split keeper ring 228 is similar to the keeper ring 160, as also shown in FIG. 5, and includes holes for passage of hydraulic fluid which circulates via radial port 236 receiving fluid connection from line 146. A toroidal shaped inner packer 238 is seated in the annular chamber 212 with its flat outer periphery 240 snugly seated against the outer packer 230 and with its rounded inner edge directed toward the lower packer 100 of insert packer 80.

The middle plate 74 of lower bonnet assembly 16 is secured to the underside of lower flange plate 62 by means of a circular array of bolts 242 as circular seals maintain fluid-tight integrity. The middle plate 74 includes a plurality of radial bores (actually three bores at 120° spacing) 244, each of which has a cylinder 246 sealingly inserted therein and defining a chamber 248. Piston 250 having rings 252 and plunger lock 254 is then slidably disposed within chamber 248. A circular cylinder head 256 is then secured around the middle plate 74 while allowing pistons 25 to extend sealingly therethrough.

Hydraulic input (not shown) to actuate pistons 250 to the unlock position is input via port 258 to the inner extent of chambers 248, and hydraulic pressure to lock position is input at port 260 to the outer extremities of chamber 248 thereby forcing the plunger lock 254 radially inward for engagement within circular groove 128. To reiterate, the upper hydraulic locking cylinders 184 and the lower hydraulic cylinders 246 are preferably employed with three units spaced 120° apart.

The lower flange assembly 18 is then secured beneath the middle plate 74 by means of a plurality of bolt fasteners 262 which are circularly arrayed in selected spacing. Suitable circular seals 264 provide the requisite fluid-tight joinder.

In operation, the blow out preventer 10 is employed in special situations such as work over operations or the like wherein one or more cables or rods may be extending down into the well bore. In particular, if a Reda pump of well-known type, a submersible pump, were suspended in the well bore then a dual cable connection is made, one for electrical power and one for pump suspension, and each cable is nearly one inch in diameter. In this case, such as the blow out preventer 10 would be used since it has the capability of rapidly sealing off around a dual cable presenting an irregular cross-section.

Figure 6:
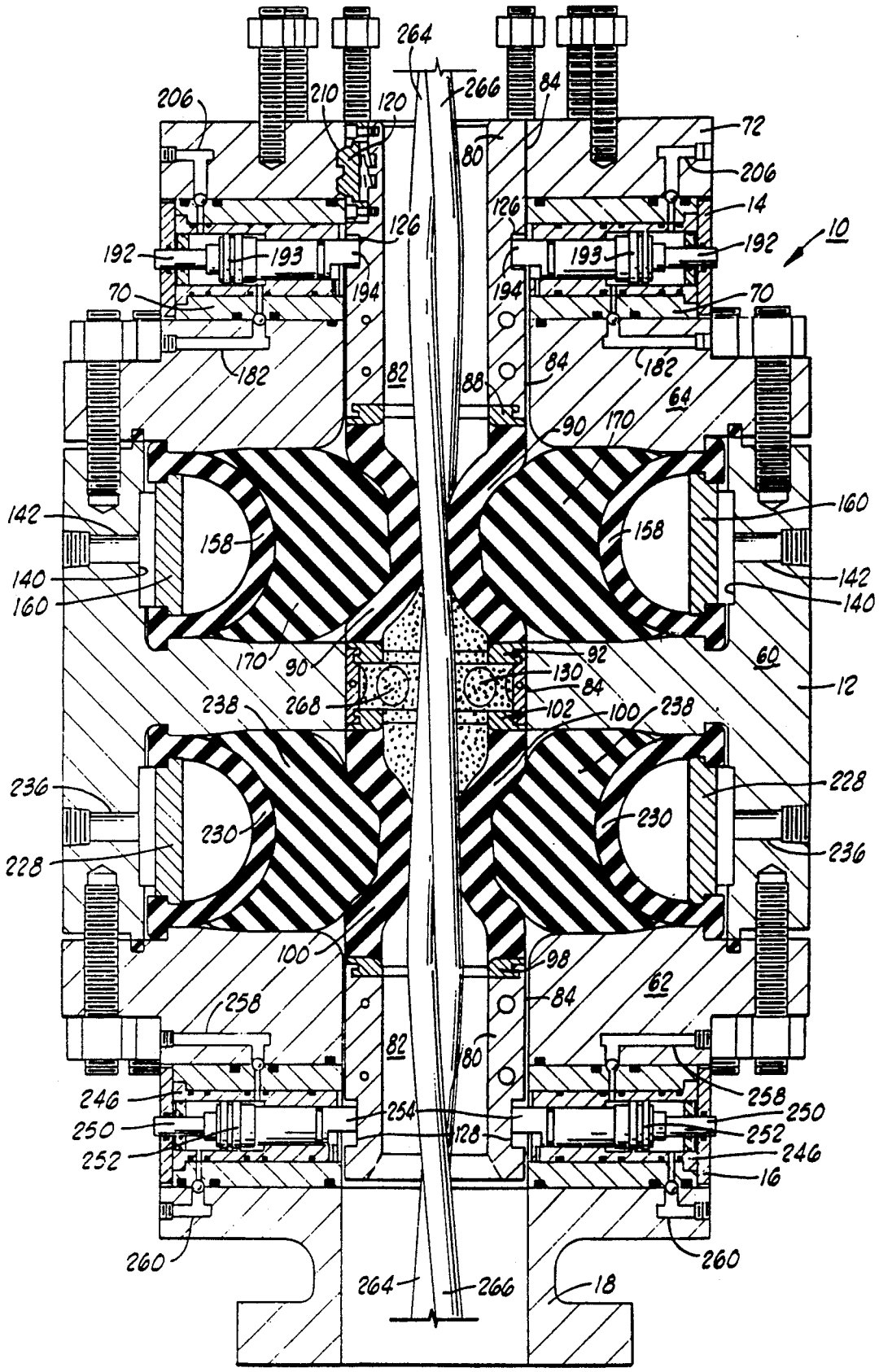
FIG. 6 is a view in vertical section of the blow-out preventer in the actuated closed attitude.

Referring primarily to FIG. 6, the blow out preventer 10 is initially set up after inspection of all parts by positioning the insert packer 80 downward within the central bore 84 of the preventer body member 12. The insert packer 80 is pre-assembled with upper and lower mandrels 86 and 94 (see FIG. 4) half sections secured by connecting rings 88 and 98 to the upper and lower half section packers 90 and 100 which, in turn, are connected to the central spacer ring 104. Two such insert packer half-sections are then combined into a full cylindrical section and bolted to form the insert packer 80.

Insert packer 80 is then slid vertically downward within central bore 84 of body member 12 (see FIG. 3) until the locking insert doglatch 120 is spring thrust into the latch receptacle or notch 210 at the top of central bore 84. Hydraulic charging of input ports 206 at each of the three (120° displaced) cylinder positions forces the respective piston 192 inward where, in each case, the plunger lock 194 is inserted within the annular groove 126. In like manner, hydraulic pressure is charged into the lower ports 260 to force each of the pistons 250 inward until the locking plunger 254 is seated within annular groove 128.

The blow out preventer 10 may then be positioned on top of the wellhead for subsequent charging of each of the injectors 24 and 2 on each side of blow out preventer 10. Referring to FIGS. 1 and 2, the ball valve 34 is closed by means of arrow handle 36 and cap screw 44 is removed whereupon a supply tube of plugging agent is connected. Pressure is then applied to force plugging agent through T-connector 32 and conduits 28 and 30 into respective injectors 24 and 26 until the injectors are full, i.e., the injector pistons are forced all the way toward the oil supply end. While this occurs, ball valve 52 is closed and ball valve 56 is opened so that any hydraulic oil present in injectors 24 and 26 will exhaust through ball valve 56 and proceed on arrow 60 to the hydraulic oil reservoir. This charging of plugging agent is carried out on each side of preventer 10 and results in the loading of approximately four half-gallons of plugging agent. A plugging agent that has been found to be very desirable is a substance known as CHEMOLA-DESCO TFE SEALANT, a castor oil/particulate TEFLON® suspension, and is commercially available from Chemola Corporation of Houston, Tex. When injectors 24 and 26 are charged, the ball valve settings for valves 34, 56 and 52 are reversed (as shown in FIG. 1) and the injector assembly 20 and 22 are ready for operation subject to emergency input of hydraulic fluid via line 54, as will be further described.

Referring again to FIG. 3, the hydraulic pressure source 144 available at the well site is connected via lines 146 and 148 to each of the opposite side ports 142 and 236. Thus, for safeguard operation, there is required the hydraulic pressure source 144 for packer actuation as well as a second hydraulic pressure source (not shown) which connects to the input line 54 to the plural injector assemblies 20 and 22 (see FIG. 1). Such as a submersible pump having control lines 264 and 266 (FIG. 6) may then be suspended down through axial bore 82 to continue down the well bore for proper positioning.

Referring again to FIG. 6, an emergency situation wherein it is required to seal off the well bore results in hydraulic pressure being applied to the plural ports 142 and 236 such that fluid under pressure is applied through respective perforate keeper rings 160 and 228 to expand the respective outer packers 158 and 230 inward thereby imparting a contractial movement of toroidal inner packers 170 and 238 to squeeze the upper and lower insert packers 90 and 100 tightly in around cables 264 and 266. The viscous plugging agent 268 from injector assemblies 20 and 22 are then energized in quick succession by hydraulic line 54 to inject viscous plugging agent down the ports 42 (FIG. 1) for deposit around the spacer ring 84 whereupon it rapidly flows through the plurality of holes 130 to totally plug the insert packer middle section between the contact points of upper and lower insert packers 90 and 100. The plugging agent 268 is an extremely viscous suspension of TEFLON® particles in a heavy castor oil and it functions to plug off strongly any passages around cables 264 and 266 that are not sealed by upper and lower packers 90 and 100. At this point, the blow out preventer 10 has carried out its function and only awaits whatever further relief measures to follow.

The foregoing discloses a novel type of blow out prevention device that is suitable for closing off around a dual cable or irregular axial line. The blow out prevention device is of such construction that it allows repeated usage without undue damage to individual components; however, when one or more components do appear torn or damaged they are easily replaced due to the modular type construction of the multiple packer assembly.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. Apparatus for connection on a wellhead to effect blow-out prevention, comprising:

an insert packer assembly of generally tubular form having first and second cylindrical elastomeric packers disposed as juxtaposed cylindrical wall sections;

a cylindrical spacer ring having radial openings and being disposed in said insert packer between the first and second elastomeric packers;

a body member for connection onto said wellhead for supporting said insert packer assembly on the wellhead, said body member having first and second annular chambers disposed adjacent said first and second elastomeric packers;

first and second contractible packer members of toroidal shape disposed in respective first and second annular chambers;

means actuatable to effect inward contraction of said contractible packer members to force said first and second cylindrical elastomeric packers inward thereby to isolate a central volume within the insert packer assembly adjacent said spacer ring; and means actuatable to inject a viscous plugging agent through said spacer ring into said central volume within the insert packer assembly.

2. Apparatus as set forth in claim 1 wherein said insert packer assembly comprises:

first and second cylindrical mandrels form each end of the assembly while connecting to respective first and second cylindrical elastomeric packers which, in turn, are joined by said cylindrical spacer ring.

3. Apparatus as set forth in claim 1 wherein said body member comprises:

a body housing having a central bore for receiving said insert packer assembly, with said first and second annular chambers opening inward toward said central bore.

4. Apparatus as set forth in claim 3 wherein said housing further comprises:

first and second radially aligned ports in communication with said first and second annular chambers for transmission of hydraulic fluid.

5. Apparatus as set forth in claim 1 wherein contractible packer members each comprise:

an elastomer inner packer member of toroidal shape having a rounded inner side and a planar outer side;

an elastomer outer packer with a planar face disposed around said inner packer in flush engagement thereto; and a keeper ring split assembly maintaining position of said outer packer outer circumference while allowing fluid communication to said outer packer.

6. Apparatus as set forth in claim 4 wherein contractible packer members each comprise:

an elastomer inner packer member of toroidal shape having a rounded inner side and a planar outer side;

an elastomer outer packer with a planar face disposed around said inner packer in flush engagement thereto; and a keeper ring split assembly maintaining position of said outer packer outer circumference while allowing hydraulic fluid communication to said outer packer.

7. Apparatus as set forth in claim 1 wherein said means actuatable to inject a viscous plugging agent comprises:

at least one injector means mounted on said body member and containing said plugging agent;

conduit means connecting from said injector means through the body member to the insert packer assembly central volume; and means actuating said injector means to flow said plugging agent into said central volume.

8. Apparatus as set forth in claim 7 wherein:

said at lease one injector means is hydraulically actuated.

9. Apparatus as set forth in claim I wherein said means actuatable to effect inward contraction comprises:

means for introducing hydraulic fluid under pressure into said first and second annular chambers to force the respective elastomeric packers inward.

10. Apparatus as set forth in claim 4 wherein said means actuatable to effect inward contraction comprises:

means for introducing hydraulic fluid under pressure into said first and second radially aligned ports in said housing.

11. Apparatus as set forth in claim 6 wherein said means actuatable to effect inward contraction comprises:

means for introducing hydraulic fluid under pressure into said first and second radially aligned ports in said housing.

12. Apparatus as set forth in claim 3 wherein said body member further comprises:

a lower flange and bonnet assembly for coactive positioning on the wellhead; and an upper bonnet assembly secured on the upper end of said body housing.

13. Apparatus for blow-out prevention of a cased well bore when a dual conduit submersible pump is suspended in the well bore, comprising:

an insert packer member of cylindrical form having first and second cylindrical elastomer walls joined by a space ring having radial holes which constitutes the middle portion of the insert packer member;

a body member supporting the insert packing member relative to said cased well bore with said dual conduit suspended through said internal packing member;

first and second annular channels formed in said body member adjacent respective ones of said first and second cylindrical elastomer walls of the insert packer member;

first and second resilient packer members of round shape disposed in said first and second annular channels;

means actuatable to cause said first and second resilient packer members to contract inward forcing said first and second cylindrical elastomer walls inward in tight seizure around said dual conduit while defining a void; and means actuatable to flow a viscous plugging agent through said spacer ring of the insert packer member to fill the void between said first and second cylindrical elastomer walls.

14. Apparatus as set forth in claim 13 wherein said body member comprises:

a body housing having a central bore through which said insert packer member is received; and upper and lower flange assemblies secured on top and on bottom, respectively, of said body housing.

15. Apparatus as set forth in claim 14 which is further characterized to include:

upper and lower hydraulically actuated plungers secured in said upper and lower flange assemblies and operable to extend a locking piston radially into engagement with said insert packer member.

16. Apparatus as set forth in claim 13 wherein said plugging agent comprises:

a viscous combination of particulate TEFLON® suspended in castor oil.

17. Apparatus as set forth in claim 14 wherein said first and second resilient packer members each comprise:

an inner packer of toroidal shape having a rounded inner edge and a cylindrical outer surface disposed in a respective one of said annular channels adjacent a respective one of the said cylindrical elastomer walls;

a respective outer packer disposed around the respective packer in juxtaposition; and means for distending inward the respective outer packer to cause contraction of the respective inner packer and elastomer wall thereby to close the insert packer member central bore while tightly seizing said dual conduit passing therethrough.

18. Apparatus as set forth in claim 17 wherein said means actuatable to flow a viscous plugging agent comprises:

a conduit formed through said body member in communication with said void in the insert packer member; and an injector means delivering said plugging agent to said conduit.

* * * * *

UNITED STATES PATENT AND TRADEMARK OFFICE

CERTIFICATE OF CORRECTION

Patent No.: 5,273,108

Dated: December 28, 1993

Inventor(s): Britton F. Piper

It is certified that error appears in the above-identified patent and that said Letters Patent is hereby corrected as shown below:

Column 2, line 53, delete "6" and substitute --60-- therefor;

Column 3, line 26, delete "screw" and substitute --screws-- therefor;

Column 5, line 28, delete "25" and substitute --250-- therefor;

Column 6, line 13, delete "2" and substitute --26-- therefor; and

Column 8, line 60, delete "space" and substitute --spacer-- therefor.

Signed and Sealed this

Twenty-eighth Day of June, 1994

*Attest:*

Bruce Lehman

BRUCE LEHMAN

*Attesting Officer*

*Commissioner of Patents and Trademarks*